US008021718B2

(12) United States Patent
Morimoto et al.

(10) Patent No.: US 8,021,718 B2
(45) Date of Patent: Sep. 20, 2011

(54) HEAT TREATMENT METHOD

(75) Inventors: Hitoshi Morimoto, Takasago (JP); Hidenobu Tamai, Takasago (JP); Yuya Fujii, Takasago (JP); Kazutaka Mori, Takasago (JP); Taiji Torigoe, Takasago (JP); Yasuhiko Tsuru, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 279 days.

(21) Appl. No.: 12/377,408

(22) PCT Filed: Sep. 14, 2007

(86) PCT No.: PCT/JP2007/067905

§ 371 (c)(1),
(2), (4) Date: Feb. 13, 2009

(87) PCT Pub. No.: WO2008/078434

PCT Pub. Date: Jul. 3, 2008

(65) Prior Publication Data

US 2010/0221441 A1 Sep. 2, 2010

(30) Foreign Application Priority Data

Dec. 25, 2006 (JP) ..... 2006-347236

(51) Int. Cl.
*B05D 1/32* (2006.01)
*B05D 3/02* (2006.01)
*C23C 16/00* (2006.01)

(52) U.S. Cl. ..... 427/272; 427/387; 427/255.6; 427/402

(58) Field of Classification Search ..... 427/387, 427/421.1, 255.23, 255.27, 255.393, 427.4; 428/632, 698, 701
See application file for complete search history.

(56) References Cited

U.S. PATENT DOCUMENTS 3,414,433 A * 12/1968 Bramer ..... 438/126
4,756,977 A * 7/1988 Haluska et al. ..... 428/704
5,814,397 A * 9/1998 Cagliostro et al. ..... 428/216
6,234,755 B1 5/2001 Bunker et al.
6,265,022 B1 * 7/2001 Fernihough et al. ..... 427/142

(Continued)

FOREIGN PATENT DOCUMENTS

JP 51-124624 10/1976

(Continued)

OTHER PUBLICATIONS

International Search Report of PCT/JP2007/067905, date of mailing Dec. 18, 2007.

(Continued)

*Primary Examiner* — Dah-Wei Yuan
*Assistant Examiner* — Jose Hernandez-Diaz
(74) *Attorney, Agent, or Firm* — Westerman, Hattori, Daniels & Adrian, LLP

(57) ABSTRACT

A silicon resin is applied to the outer wall of the transition piece of a gas turbine subjected to the thermal barrier coating by caulking the cooling holes provided in the inner wall by a resin. Then, the transition piece is heated in an atmosphere furnace in order to burn or decompose the resin. A part of the silicon resin applied to the outer wall of the transition piece is decomposed or evaporated by the heating to be discharged to the atmosphere in the furnace, but a part of the silicon resin remains and protects the outer wall.

8 Claims, 5 Drawing Sheets

U.S. PATENT DOCUMENTS

| | | | | |
|---|---|---|---|---|
| 6,875,464 | B2 * | 4/2005 | Ruud et al. | 427/142 |
| 2003/0232196 | A1 * | 12/2003 | Anand et al. | 428/405 |
| 2005/0084657 | A1 * | 4/2005 | Ohara | 428/195.1 |
| 2007/0009666 | A1 * | 1/2007 | Davisson et al. | 427/421.1 |

FOREIGN PATENT DOCUMENTS

| | | | |
|---|---|---|---|
| JP | 55-12180 | A | 1/1980 |
| JP | 55-12180 | B2 | 3/1980 |
| JP | 1-180950 | A | 7/1989 |
| JP | 2001-173405 | A | 6/2001 |
| JP | 2006-35806 | A | 2/2006 |
| KR | 10-1995-0014273 | B1 | 8/1988 |

OTHER PUBLICATIONS

Korean Office Action dated Mar. 8, 2011, issued in corresponding Korean patent Application No. 2009-7004492.

* cited by examiner

10

HEAT TREATMENT METHOD

TECHNICAL FIELD

The present invention relates to a heat treatment method of a product required to be subjected to a heat treatment during a manufacturing process.

BACKGROUND ART

As a heat treatment carried out during a product manufacturing process, there are known a heat treatment carried out to improve toughness or the like by changing a structure of a product and also a heat treatment carried out to remove any unrequired material applied to the product. An example of the unrequired material is a masking used in performing a coating or the like to a surface of the product, and the masking is decomposed or burned to be removed therefrom by performing an ashing process, which is an example of the heat treatment (see Patent Document 1).

PATENT DOCUMENT 1: Japanese Unexamined Patent Application, First Publication No. 2001-173405 (Page 7)

DISCLOSURE OF THE INVENTION

Problem that the Invention is to Solve

However, since the heat treatment is carried out in an ambient atmosphere due to the characteristics of the product in some cases, a problem arises in that oxidization occurs on the surface of the product upon performing the heat treatment in an ambient atmosphere. Additionally, since unevenness in color caused by light interference occurs on the surface of the product due to the oxidization in some cases, a problem arises in an external appearance due to the unevenness in color. Then, in the related art, the surface of the product is polished by a polishing device or the like and the oxidized portion is removed. However, a problem arises in that a manufacturing process is complicated. And also it takes much time to perform the polishing.

Means for Solving the Problem

Therefore, the present invention is contrived to solve the problems, and an object of the invention is to provide a heat treatment method in which oxidization generated by a heat treatment and unevenness in color caused by the oxidization are reduced.

In order to achieve the above-described object, in a heat treatment method of putting and heating a product in a furnace, the product is heated together with a silicon resin.

ADVANTAGE OF THE INVENTION

According to the heat treatment method of the present invention, since the surface of the product is protected by the silicon resin, it is possible to reduce the oxidization or the unevenness in color caused by the oxidization occurring on the surface of the product. For this reason, it is possible to remarkably reduce the work time required to improve an external appearance of the product after the heat treatment thereof.

DESCRIPTION OF REFERENCE NUMERALS

1: TRANSITION PIECE
1*a*: INNER WALL
1*b*: OUTER WALL
2: COOLING HOLE
3: COOLING GROOVE
4: RESIN
5: BOND COATING
6: TOP COATING
7: SILICON RESIN
8: CONTAINER
10: GAS TURBINE
10*a*: CASING
11: COMBUSTOR
11*a*: COMBUSTOR BASKET
11*b*: COMBUSTOR COVER
11*c*: PILOT NOZZLE
11*d*: MAIN NOZZLE
12: COMPRESSOR
13: TURBINE
13*a*: TURBINE BLADE

BEST MODE FOR CARRYING OUT THE INVENTION

Hereinafter, a heat treatment method according to embodiments of the invention will be described. The heat treatment method according to the embodiments is applicable to various products required to be subjected to heat treatments. However, a transition piece included in a gas turbine is exemplified, and a case will be described in which the heat treatment method according to the embodiments is applied to an ashing process performed on the transition piece. Then, since the treatment before performing the heat treatment according to the embodiments to the transition piece of the combustor is carried out in the same manner in the embodiments, first, the combustor provided with the transition piece will be described, and the treatment before the heat treatment according to the embodiments will be described.

<Combustor>

Figure 1:
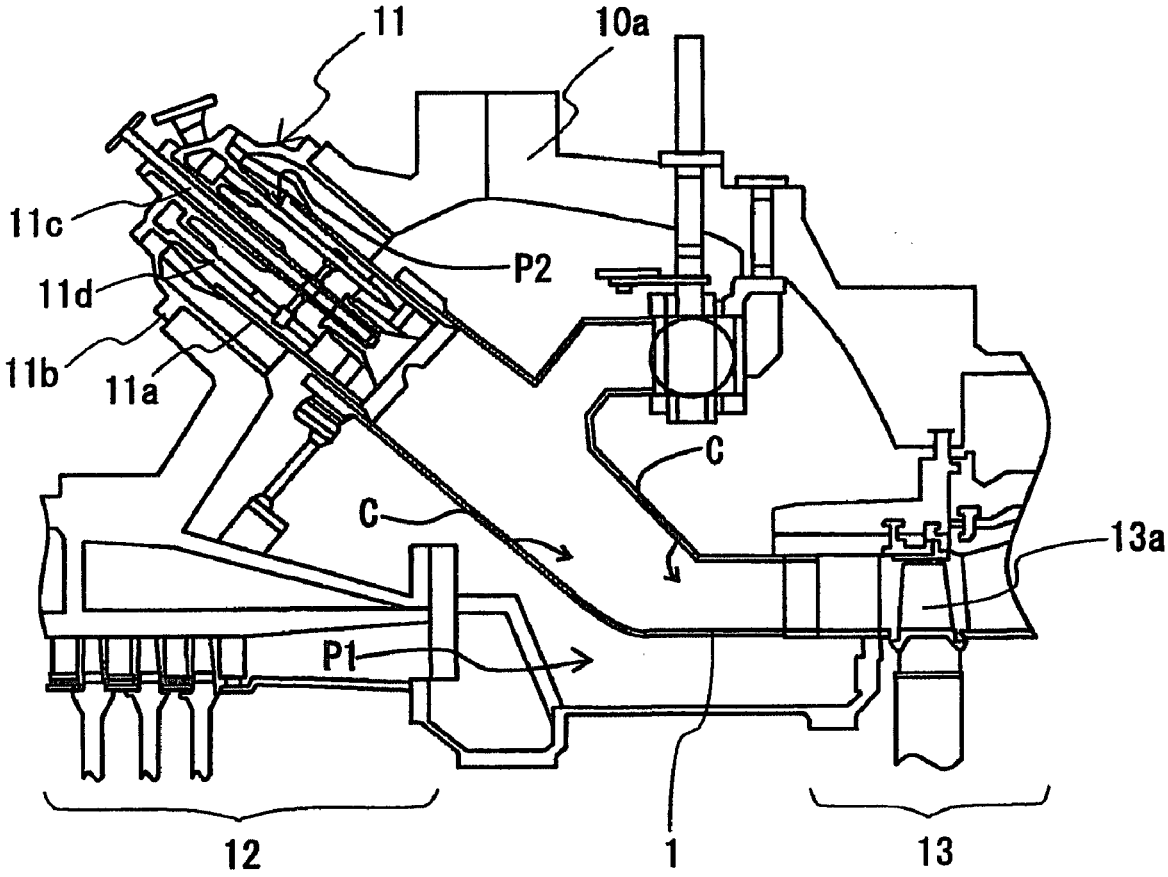
FIG. 1 is a cross-sectional view schematically showing a part in the vicinity of a combustor of a gas turbine.

First, a combustor 11 will be described with reference to FIG. 1. FIG. 1 is a cross-sectional view schematically showing a part in the vicinity of the combustor 11 of a gas turbine 10. As shown in FIG. 1, the part in the vicinity of the combustor 11 of the gas turbine 10 is provided with a casing 10*a* as an outer frame of the combustor 11. Additionally, the combustor 11 includes a combustor basket 11*a* which generates combustion gas by burning compressed air and fuel therein; a combustor cover 11*b* which is provided on the outside of the combustor basket 11*a* and is fixed to the casing 10*a*; a pilot nozzle 11*c* which is provided in a shaft of the combustor basket 11*a*; a plurality of main nozzles 11*d* which is arranged in the outer periphery of the pilot nozzle 11*c*; and a transition piece 1 which is connected to the combustor basket 11*a* and sends the combustion gas to a turbine 13 described below. Further, the gas turbine 10 includes a compressor 12 which supplies the compressed air to the inside of the casing 10*a* and the turbine 13 which generates power by supplying the combustion gas generated from the combustor 11 thereto.

The compressed air generated by the compressor 12 is discharged to the casing 10*a* as depicted by the arrow P1, and is supplied from a gap between the combustor cover 11*b* and the combustor basket 11*a* to the inside of the combustor basket 11*a* as depicted by the arrow P2. In the inside of the combustor basket 11*a*, a diffusion combustion and a premixed combustion are carried out by means of the main nozzles 11*d* and the pilot nozzle 11*c* to which fuel is supplied to thereby generate high temperature and pressure combustion gas. The generated combustion gas is discharged to the turbine 13 via the inside of the transition piece 1, and the discharged combustion gas is applied to a turbine blade 13*a* provided in the turbine 13 to be rotated, thereby obtaining power from the gas turbine 10.

<Cooling Structure for Transition Piece>

Figure 2:
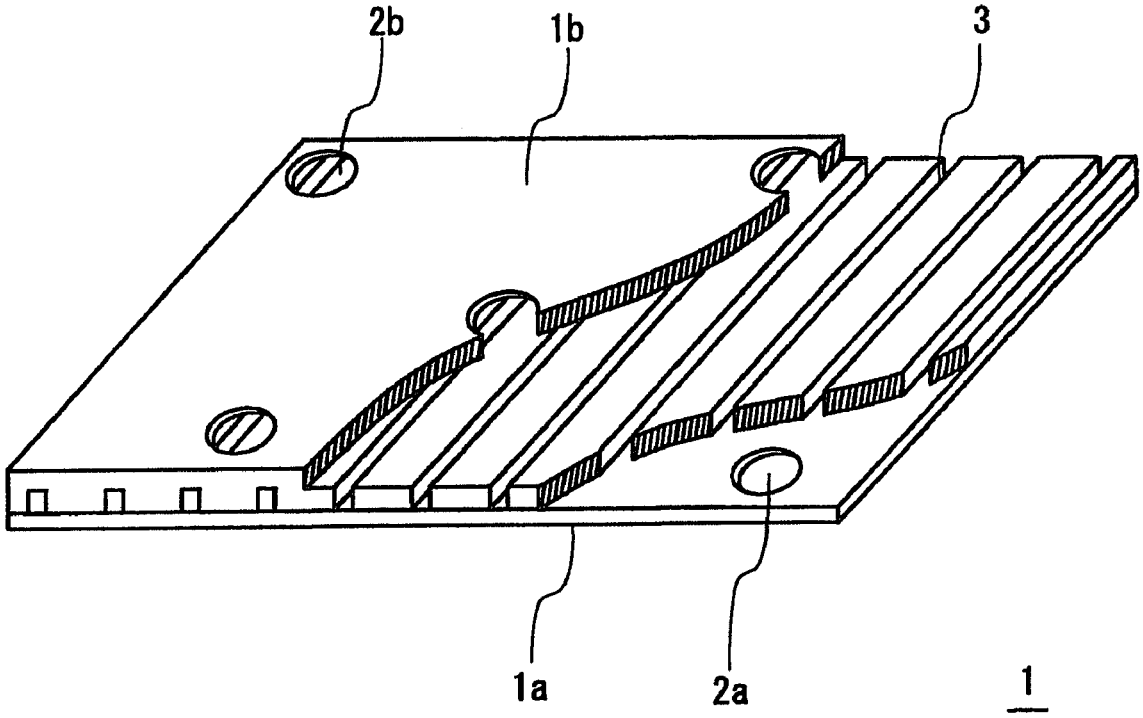
FIG. 2 is a perspective view schematically showing a wall portion of a transition piece.

As described above, since the high temperature and pressure gas passes through the inside of the transition piece 1, the transition piece is made of Ni-base alloy or the like having good heat resistance and corrosion resistance and a wall portion thereof is provided with a cooling structure. Hereinafter, the cooling structure provided in the wall portion of the transition piece will be described with reference to FIG. 2 in addition to FIG. 1. FIG. 2 is a perspective view schematically showing the wall portion of the transition piece, where a part thereof is cut out in order to show the inner configuration of the wall portion.

As depicted by the arrow C shown in FIG. 1, the transition piece 1 includes the cooling structure which sucks the compressed air from the outer wall to cool the wall portion and discharges the compressed air to the inside of the transition piece 1. Then, as shown in FIG. 2, the cooling structure includes a plurality of cooling holes 2*a* and 2*b* which is provided in the inner wall 1*a* and the outer wall 1*b* of the transition piece and cooling grooves 3 which are provided in the inside of the wall portion and connect the cooling holes 2*a* and 2*b* to each other. The compressed air enters from the cooling holes 2*b* provided in the outer wall 1*b* to the inside of the wall portion, passes through the cooling grooves 3, and then is discharged from the cooling holes 2*a* provided in the inner wall 1*a* of the transition piece to the inside of the transition piece. Then, when the compressed air passes through the cooling grooves 3 provided in the inside of the wall portion of the transition piece 1 in this manner, the wall portion of the transition piece 1 is cooled to thereby prevent overheating.

<Thermal Barrier Coating>

Figure 3A:
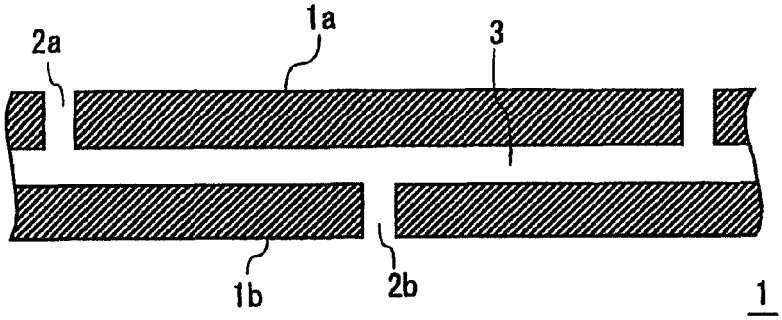
FIG. 3A is a cross-sectional view showing the transition piece subjected to a thermal barrier coating.

Additionally, a thermal barrier coating is performed on the inner wall 1*a* of the transition piece 1. The thermal barrier coating will be described with reference to FIGS. 3A to 3E. FIGS. 3A to 3E are cross-sectional views schematically showing the transition piece and showing the section disposed in substantially parallel to the cooling grooves provided in the wall portion of the transition piece. Further, FIG. 3A shows the transition piece not yet subjected the thermal barrier coating.

Figure 3B:
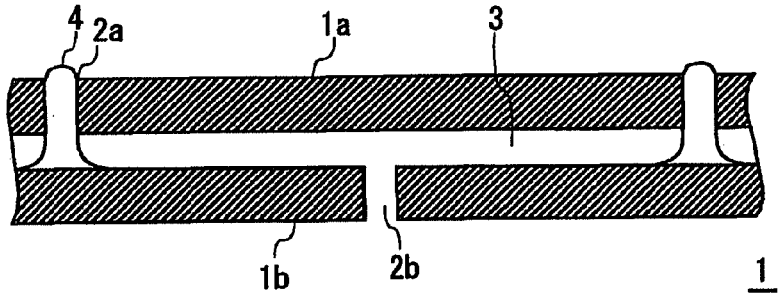
FIG. 3B is a cross-sectional view showing the transition piece subjected to the thermal barrier coating.

Before performing the thermal barrier coating, first, as shown in FIG. 3B, resin 4 is inserted and cured in the cooling holes 2*a* provided in the inner wall 1*a* of the transition piece 1 so as to completely caulk the cooling holes 2*a*, thereby preventing a fine particle used for a blasting described below and a thermal barrier coating material used for the thermal barrier coating from entering the cooling holes 2*a*. Additionally, any type of resin may be used as the resin 4 inserted at this time so long as the resin is capable of withstanding a temperature of about 200° C. as a temperature of the transition piece 1 upon performing the thermal barrier coating described below to the transition piece 1 and the resin is burned or decomposed at a temperature of 200° C. or more. For example, acryl-based resin or silicon-based resin may be used. Further, urethane-based resin may be used.

Figure 3C:
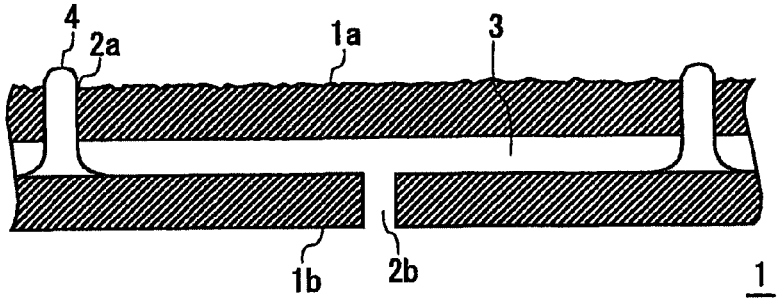
FIG. 3C is a cross-sectional view showing the transition piece subjected to the thermal barrier coating.

As shown in FIG. 3B, when the cooling holes 2*a* are caulked by the resin 4, the blasting is performed on the inner wall 1*a* of the transition piece 1. The blasting is a treatment in which a surface is made to be rough by means of a high-speed collision of fine particles such as alumina. When the blasting is performed on the inner wall 1*a* of the transition piece 1, as shown in FIG. 3C, the surface of the inner wall 1*a* of the transition piece 1 is made to be rough.

Then, the inner wall 1*a* of the transition piece 1 having the rough surface is subjected to the thermal barrier coating by means of a thermal spray to thereby obtain a thermal barrier coating. Here, two types of coatings are formed as the thermal barrier coating, the two types of coatings being a top coating 6 formed for a thermal barrier and a bond coating 5 formed to obtain good adhesiveness between the top coating 6 and the inner wall 1*a* of the transition piece 1 as a base or to prevent oxidization of the base.

Figure 3D:
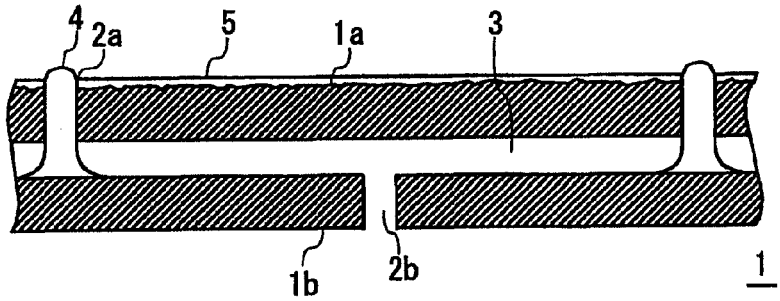
FIG. 3D is a cross-sectional view showing the transition piece subjected to the thermal barrier coating.

First, as shown in FIG. 3D, the bond coating 5 is formed in the inner wall 1*a* of the transition piece 1. In a case where the transition piece 1 is made of Ni-base alloy, as the bond coating 5, for example, alloy such as MCrAlY (M is any one of Fe, Ni, and Co or alloy thereof) may be used. Since the bond coating 5 is formed to have a thickness of several tens of μm to several thousands of μm and the base is formed as a rough surface, an adhering operation is easily carried out by means of an anchor effect. Additionally, the resin 4 caulking the cooling holes 2*a* and the bond coating 5 have poor wettability in many cases. In such cases, the bond coating 5 may not be formed on the resin 4.

Figure 3E:
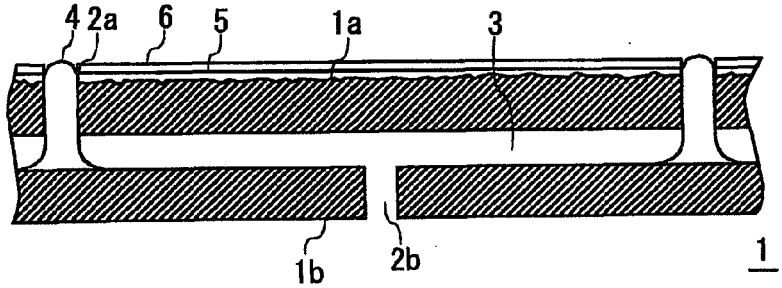
FIG. 3E is a cross-sectional view showing the transition piece subjected to the thermal barrier coating.

Then, as shown in FIG. 3E, the top coating 6 is formed on the inner wall 1*a* of the transition piece 1 having the bond coating 5 formed thereon by means of a thermal spray. As the top coating 6, for example, a ceramic material mainly made of zirconia may be used. The top coating 6 is formed to have a thickness of several tens of μm to several thousands of μm, and is formed into a plurality of layers in some cases. The top coating 6 and the resin 4 caulking the cooling holes 2*a* have poor wettability in many cases. In such cases, the top coating 6 may not be formed on the resin 4.

As described above, the thermal barrier coating is performed on the inner wall 1*a* of the transition piece 1 by means of the thermal spray. After performing the thermal barrier coating to the transition piece 1, it is necessary to perform an ashing process as one of the heat treatments to the transition piece 1 in order to remove the resin 4 inserted in the cooling holes 2*a*. Then, the present invention relates to a heat treatment method of the product required to be subjected to the heat treatment, the product being, for example, the transition piece 1. In the following embodiments, a case will be exemplified in which the ashing process as the heat treatment is performed on the transition piece 1.

First Embodiment

Figure 4A:
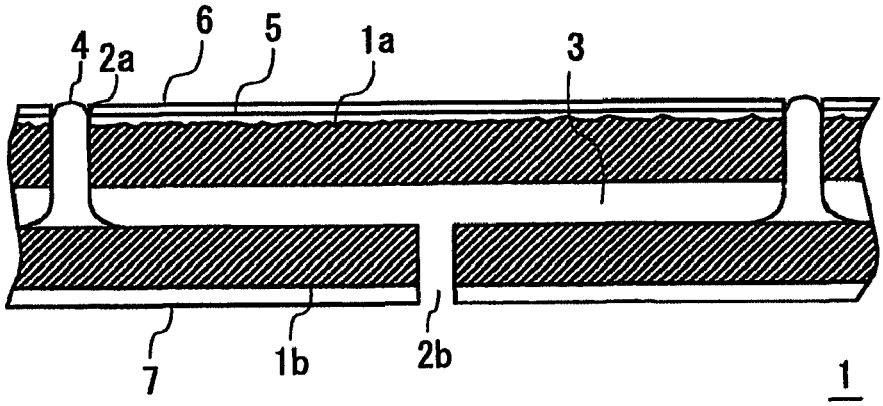
FIG. 4A is a cross-sectional view showing the transition piece subjected to a heat treatment according to a first embodiment.
Figure 4B:
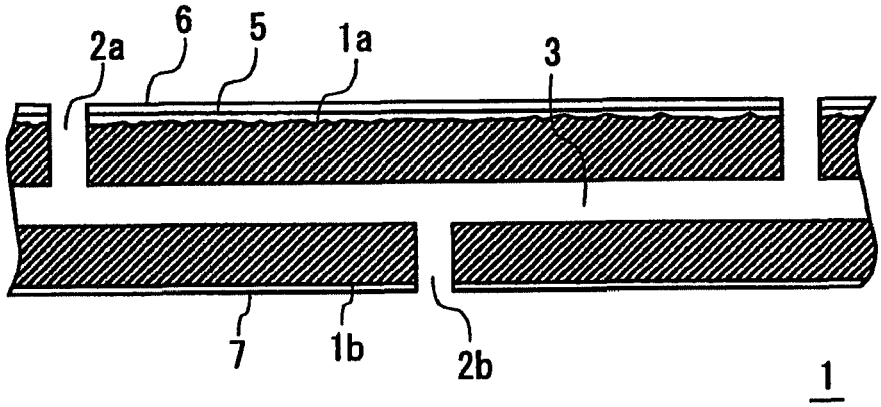
FIG. 4B is a cross-sectional view showing the transition piece subjected to the heat treatment according to the first embodiment.

Hereinafter, the heat treatment method according to a first embodiment will be described by means of the example of the ashing performed on the transition piece and FIGS. 4A and 4B. FIGS. 4A and 4B are cross-sectional views schematically showing the transition piece and corresponding to FIGS. 3A to 3E showing the transition piece subjected to the thermal barrier coating.

In the heat treatment method according to this embodiment, as shown in FIG. 3E, the inner wall 1*a* is subjected to the thermal barrier coating, and the outer wall 1*b* of the transition piece 1 is applied with silicon resin 7 as shown in FIG. 4A. The silicon resin 7 is formed such that a side chain such as methyl is bonded to each Si of a main chain composed of a plurality of Si and O alternately arranged, and may be formed in various states such as a liquid state or a paste state in accordance with a bonding type. Here, the silicon resin 7 being in a paste state is directly applied to the outer wall 1*b* of the transition piece 1.

As shown in FIG. 4A, after the silicon resin 7 is applied to the outer wall 1*b* of the transition piece 1, the transition piece 1 is heated in an atmosphere furnace in order to burn or decompose the resin 4 caulking the cooling holes 2*a* provided in the inner wall 1*a*. At this time, in order to completely burn or decompose the resin 4, the heating is carried out for several hours at a temperature of 400° C. (additionally, the temperature may be set to any temperature capable of burning or decomposing the resin 4 caulking the cooling holes 2*a* of the transition piece 1). Then, the resin 4 caulking the cooling holes 2*a* is burned or decomposed to be removed therefrom. A part of the silicon resin 7 applied to the outer wall 1*b* of the transition piece 1 is decomposed or evaporated by the heating to be discharged to the atmosphere in the furnace, but a part of the silicon resin 7 remains in the outer wall 1*b*. Additionally, as a result of a heating test performed on the silicon resin 7 being in a paste state, it is found out that 40% or so of the silicon resin is discharged to the atmosphere, but 60% or so of the silicon resin remains in a case where the silicon resin 7 is heated at a temperature of 400° C. or more.

Then, since the remaining silicon resin 7 protects the outer wall 1*b* of the transition piece 1, it is possible to reduce oxidization of the outer wall 1*b* or an unevenness in color caused by the oxidization. For this reason, even when the resin 4 inserted in the cooling holes 2*a* is removed by performing the ashing process to the transition piece 1, the unevenness in color hardly occurs in the outer wall 1*b* of the transition piece 1, and thus the time required to perform a polishing to the outer wall 1*b* becomes unnecessary or short. Accordingly, it is possible to remarkably reduce the time required to improve an external appearance after the ashing process by applying the heat treatment method according to this embodiment to the ashing process performed on the transition piece 1.

Additionally, even when the silicon resin 7 is non-uniformly applied or a large amount of the silicon resin is applied, it is possible to easily remove the remaining silicon resin 7. For this reason, it is possible to further reduce the work time after the ashing process compared with a case in which the unevenness in color is removed by means of a polishing device according to the related art. Further, when the silicon resin 7 is uniformly applied or an appropriate amount of the silicon resin is applied, it is possible to satisfactorily keep the external appearance of the transition piece 1 after the ashing process without removing the remaining silicon resin 7.

Further, the silicon resin 7 being in a paste state is directly applied to the transition piece 1, but the silicon resin 7 being in a liquid state and having low viscosity may be applied. Further, in addition to the direct application method, the application method may be a method of spraying the silicon resin 7 in a mist state to the outer wall 1*b* of the transition piece 1 by means of a spray. Since it is possible to easily and promptly apply the silicon resin 7, it is possible to simplify a work process and to reduce work time.

Furthermore, it is possible to uniformly apply the silicon resin 7 to the outer wall 1*b* of the transition piece 1 by means of the spray. Moreover, it is possible to easily apply the silicon resin to a minute gap or the like by means of the spray, as the minute gap is a portion where the direct application method is difficult to be used.

Second Embodiment

Figure 5:
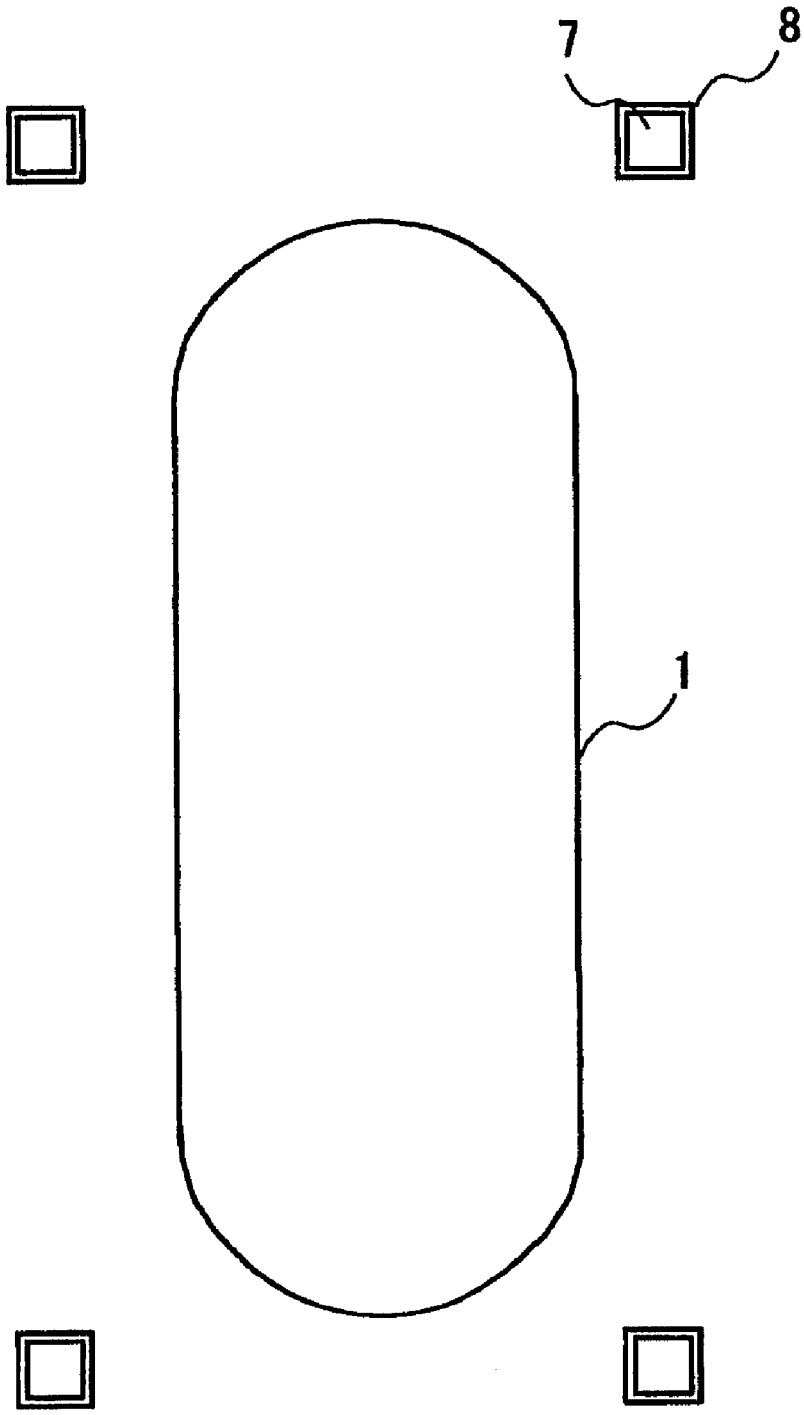
FIG. 5 is a schematic view showing an example of a heat treatment method according to a second embodiment.

Next, a heat treatment method according to a second embodiment will be described in the same manner as the first embodiment by means of the example of the ashing process performed on the transition piece and FIG. 5. FIG. 5 is a schematic view showing an example of the heat treatment method according to this embodiment.

Regarding the transition piece 1 subjected to the thermal barrier coating as shown in FIG. 3E, in the first embodiment, the silicon resin 7 is directly applied to the outer wall of the transition piece 1 as shown in FIG. 4A. However, in this embodiment, a container 8 equipped with the silicon resin 7 is disposed around the position of the transition piece 1, and the transition piece 1 is heated together with the silicon resin 7 as shown in FIG. 5.

Additionally, the containers 8 are capable of withstanding an ashing temperature in the transition piece 1, and are disposed at the position around four corners of the transition piece 1. At this time, the containers 8 equipped with the silicon resin 7 and disposed at the position around four corners of the transition piece 1 is distanced from the transition piece 1, for example, by about 10 cm, and a sectional area of the container 8 is set to be several tens to several hundreds of $cm^2$. Then, the transition piece 1 is heated together with the container 8 equipped with the silicon resin 7 in the atmosphere furnace to perform the ashing process.

When such an ashing process is carried out, as described in the first embodiment, a part of the silicon resin 7 remains in the container 8, but a part thereof is decomposed or evaporated by a heat in the furnace to be thereby discharged to the atmosphere in the furnace. Then, the surface of the transition piece 1 is protected by the discharged silicon resin 7.

In this manner, when the surface of the transition piece 1 is protected by the silicon resin 7 discharged to the atmosphere in the furnace, it is possible to reduce the unevenness in color caused by the oxidization occurring on the surface of the transition piece 1. For this reason, even when the ashing process is performed on the whole part of the transition piece 1 so as to remove the resin, the unevenness in color caused by the oxidization hardly occurs in the outer wall of the transition piece 1, and thus the time required to perform a polishing to the outer wall of the transition piece 1 before the shipment becomes unnecessary or short. Accordingly, it is possible to remarkably reduce the work time after the ashing process by performing the heat treatment method according to this embodiment.

Additionally, since the surface of the transition piece 1 is protected by discharging a part of the silicon resin 7 to the atmosphere in the furnace, it is possible to easily protect a minute part where the silicon resin 7 cannot be directly applied to the transition piece 1. Further, since the surface of the transition piece 1 is protected just by heating the transition piece 1 together with the silicon resin 7 in the furnace, it is possible to perform the ashing process while protecting the surface of the transition piece in a simple manner.

Further, a heating device such as a heater may be provided in the container 8 equipped with the silicon resin 7 so that the temperature of the container 8 and the silicon resin 7 is equal to a temperature at which the decomposition and the evaporation of the silicon resin 7 are optimally carried out. With such a configuration, since it is possible to discharge a sufficient amount of the silicon resin 7 to the atmosphere in the furnace in terms of the decomposition or the evaporation, it is possible to efficiently protect the surface of the transition piece 1.

Furthermore, the transition piece 1 and the container 8 equipped with the silicon resin 7 may have a positional relationship different from that shown in FIG. 5. For example, a plurality of containers 8 may be sequentially arranged so as to surround the transition piece 1, and a sectional area of each container 8 may be large or small. In addition, instead of arranging the containers 8 equipped with the silicon resin 7, a stage filled with the silicon resin may be disposed or the silicon resin 7 may be filled around the position of the transition piece 1 in the furnace.

Moreover, upon performing the ashing process to the transition piece 1, the silicon resin 7 may be maintained for a predetermined time at a temperature at which the silicon resin is easily discharged to the atmosphere in the furnace, and the temperature may increase up to a temperature at which the ashing process is carried out. When the two-stage heat treatment is carried out in this manner, the surface of the transition piece 1 is capable of being protected by sufficiently discharging the silicon resin to the atmosphere in the furnace, and the ashing process is capable of being carried out so as to burn or decompose the resin. Accordingly, it is possible to more efficiently reduce the oxidization or the unevenness in color caused by the oxidization.

In the first and second embodiments, a case is exemplified in which the heat treatment method is applied to the ashing process performed on the transition piece provided in the combustor of the gas turbine. However, the heat treatment method according to the first and second embodiments is not limited to the application to the ashing process for burning or decomposing the resin inserted in the cooling holes of the transition piece, but may be applied to the whole product required to be subjected to the heat treatment maintained at a high temperature in order to prevent the oxidization of the surface thereof or the unevenness in color caused by the oxidization. For example, the oxidization or the unevenness in color caused by the oxidization may be prevented in such a manner that the heat treatment method according to the first and second embodiments is applied to a product required to be subjected to the heat treatment such as a tempering or an annealing. Additionally, the heat treatment method according to the first and second embodiments is not limited to the application to the transition piece as an example of a product made of Ni-base alloy, but may be applied to, for example, a product made of cobalt-base alloy or iron-base alloy.

Additionally, the protection may be more efficiently carried out by appropriately selecting the type of the silicon resin in accordance with the heat treatment temperature or the heat treatment method. Particularly, a temperature at which the silicon resin is decomposed or evaporated by the heating is changed in accordance with the type of the silicon resin, that is, a bonding type such as a bonding degree of a main chain and a type of a side chain and an additive or the like applied to the resin. For this reason, since it is possible to efficiently protect the surface of the product by selecting the appropriate silicon resin in accordance with the heat treatment temperature, it is possible to perform the efficient heat treatment to all products.

For example, in the second embodiment, in a case where the two-stage heat treatment is carried out in such a manner that the temperature is maintained at a certain temperature and increases up to an ashing temperature in order to discharge the silicon resin to the atmosphere in the furnace, the silicon resin discharged to the atmosphere in the furnace at a lower temperature may be used. Then, when such silicon resin is selected, it is possible to prevent a case in which the oxidization or the undesired deformation of the product occurs during the time when the temperature is maintained at a certain temperature in order to discharge the silicon resin to the atmosphere in the furnace.

Additionally, in the example of the ashing process performed on the transition piece, the atmosphere furnace is used, but the heat treatment method according to the first and second embodiments may be carried out by means of a furnace being in a vacuum atmosphere or in an inactive gas atmosphere, the inactive gas being nitrogen or argon. With such a configuration, it is possible to protect the product from a small amount of oxygen remaining in the furnace, and thus to prevent the oxidization or the unevenness in color caused by the oxidization from occurring in the product.

INDUSTRIAL APPLICABILITY

The present invention is applicable to the heat treatment method of the product required to be subjected to the heat treatment, and is applicable to, for example, the ashing process for removing the unnecessary material applied to the product or the tempering and the annealing for changing the structure of the product.

The invention claimed is:

1. A heat treatment method for a transition piece of a combustor, comprising:

caulking holes provided in an inner wall with a resin, wherein said inner wall and an outer wall make up a wall portion of the transition piece of the combustor, said outer wall having holes communicating with said holes provided in said inner wall via grooves formed on an inside of said wall portion of the transition piece;

putting the transition piece, with the caulked holes in the inner wall, in a furnace; and heating the transition piece in the furnace, wherein the transition piece is heated together with a silicone resin at a temperature such that only a part of said silicone resin is discharged to the atmosphere in the furnace while completely removing the resin in said holes of the inner wall of the wall portion of the transition piece.

2. The heat treatment method for the transition piece of the combustor according to claim 1, wherein the transition piece having a surface applied with the silicon resin is put in the furnace, and then the transition piece is heated in the furnace.

3. The heat treatment method for the transition piece of the combustor according to claim 2, wherein the silicon resin being in a liquid state or a paste state is applied to the surface of the transition piece.

4. The heat treatment method for the transition piece of the combustor according to claim 2, wherein the silicon resin being in a mist state is sprayed to the surface of the transition piece to be applied thereon.

5. The heat treatment method for the transition piece of the combustor According to claim 1, wherein in the furnace, placing the silicon resin at a position around the transition piece so as not to contact with the transition piece, and then heating the transition piece together with the silicon resin.

6. The heat treatment method for the transition piece of the combustor according to claim 1, wherein an atmosphere in the furnace is equivalent to an ambient atmosphere.

7. The heat treatment method for the transition piece of the combustor according to claim 1, wherein a heating temperature in the furnace is equivalent to a temperature at which the silicon resin is decomposed or evaporated.

8. The heat treatment method for the transition piece of the combustor according to claim 1, wherein said resin provided in said holes of said inner wall is acryl-based, silicon-based or urethane-based.

* * * * *